US007323965B2

(12) United States Patent
Yoshikawa

(10) Patent No.: US 7,323,965 B2
(45) Date of Patent: Jan. 29, 2008

(54) THERMAL FUSE USING THERMOSENSITIVE MATERIAL

(75) Inventor: Tokihiro Yoshikawa, Koka (JP)

(73) Assignee: NEC SCHOTT Components Corporation, Koka-shi (JP)

( * ) Notice: Subject to any disclaimer, the term of this patent is extended or adjusted under 35 U.S.C. 154(b) by 203 days.

(21) Appl. No.: 10/512,167

(22) PCT Filed: Apr. 22, 2003

(86) PCT No.: PCT/JP03/05126

§ 371 (c)(1),
(2), (4) Date: Oct. 20, 2004

(87) PCT Pub. No.: WO03/092028

PCT Pub. Date: Nov. 6, 2003

(65) Prior Publication Data

US 2005/0179516 A1 Aug. 18, 2005

(30) Foreign Application Priority Data

Apr. 24, 2002 (JP) ..... 2002-121714

(51) Int. Cl.
*H01H 85/06* (2006.01)
*H01H 85/055* (2006.01)

(52) U.S. Cl. ..... 337/408; 337/401; 337/159

(58) Field of Classification Search ..... 337/401, 337/407, 408, 159
See application file for complete search history.

(56) References Cited

U.S. PATENT DOCUMENTS

| | | | |
|---|---|---|---|
| 3,180,958 | A | 4/1965 | Merrill |
| 3,281,559 | A | 10/1966 | Ebensteiner |
| 3,529,270 | A | 9/1970 | Kozacka |
| 3,727,164 | A | 4/1973 | Cartier et al. |
| 3,781,737 | A | 12/1973 | Henry |

(Continued)

FOREIGN PATENT DOCUMENTS

DE 24 57 223 10/1975

(Continued)

OTHER PUBLICATIONS

U.S. Appl. No. 10/971,166, filed Oct. 22, 2004, Yoshikawa.

(Continued)

*Primary Examiner*—Anatoly Vortman
(74) *Attorney, Agent, or Firm*—W. F. Fasse; W. G. Fasse

(57) ABSTRACT

In the present invention, a physical and chemical property of thermosensitive material is noted in selecting and using thermosensitive material to provide a noble and improved thermal fuse using thermosensitive material. To achieve this object, the present thermal fuse includes: a thermosensitive material formed of thermoplastic resin fusing at a prescribed temperature; a cylindrical enclosure accommodating the thermosensitive material; a first lead member attached at one opening of the enclosure, forming a first electrode; a second lead member attached at the other opening of the enclosure, forming a second electrode; a movable conductive member accommodated in the enclosure and engaged with the thermosensitive material; and a spring member accommodated in the enclosure, and pressed against and thus acting on the movable conductive member. When the thermosensitive material fuses at an operating temperature an electrical circuit between the first and second electrodes is switched.

9 Claims, 1 Drawing Sheet

U.S. PATENT DOCUMENTS

| | | | | | |
|---|---|---|---|---|---|
| 3,815,071 | A | | 6/1974 | Sleeter | |
| 3,930,215 | A | | 12/1975 | Senor | |
| 4,001,754 | A | | 1/1977 | Plasko | |
| 4,065,741 | A | * | 12/1977 | Sakamoto et al. | 337/407 |
| 4,068,204 | A | | 1/1978 | Iwanari et al. | |
| 4,084,147 | A | | 4/1978 | Mlyniec et al. | |
| 4,184,139 | A | | 1/1980 | Hara | |
| 4,189,697 | A | | 2/1980 | Hara | |
| 4,259,656 | A | | 3/1981 | Smith | |
| 4,276,531 | A | | 6/1981 | Davis | |
| 4,276,532 | A | * | 6/1981 | Aoki | 337/408 |
| 4,281,309 | A | * | 7/1981 | Olson | 337/409 |
| 4,286,248 | A | | 8/1981 | Hara | |
| 4,322,705 | A | | 3/1982 | Hara | |
| 4,384,267 | A | * | 5/1983 | Aoki | 337/407 |
| 4,480,247 | A | | 10/1984 | Hara | |
| 4,514,718 | A | | 4/1985 | Birx | |
| 4,529,957 | A | | 7/1985 | Hara | |
| 4,630,023 | A | | 12/1986 | Gawron et al. | |
| 4,821,010 | A | | 4/1989 | Plasko | |
| 4,973,932 | A | * | 11/1990 | Krueger et al. | 337/164 |
| 5,357,234 | A | | 10/1994 | Pimpis et al. | |
| 5,473,303 | A | | 12/1995 | Hohider | |
| 5,532,030 | A | | 7/1996 | Hirose et al. | |
| 5,612,663 | A | * | 3/1997 | Hollweck | 337/407 |
| 6,440,492 | B1 | | 8/2002 | Coran | |
| 6,673,257 | B1 | | 1/2004 | Hudson | |
| 6,710,310 | B2 | | 3/2004 | Hantz | |
| 6,982,112 | B2 | | 1/2006 | Coran | |
| 2003/0112117 | A1 | | 6/2003 | Miyashita | |
| 2003/0220460 | A1 | | 11/2003 | Merfeld | |
| 2006/0208845 | A1 | | 9/2006 | Yoshikawa | |

FOREIGN PATENT DOCUMENTS

| | | | |
|---|---|---|---|
| EP | 1120432 | | 8/2001 |
| EP | 1 308 974 | | 5/2003 |
| GB | 2 011 724 | | 7/1979 |
| JP | 50-138354 | | 11/1975 |
| JP | 51-145538 | | 11/1976 |
| JP | 52-144046 | | 12/1977 |
| JP | 57-094142 | | 6/1982 |
| JP | 57-103647 | | 6/1982 |
| JP | 57-140034 | | 9/1982 |
| JP | 60-138819 | | 7/1985 |
| JP | 62-246217 | | 10/1987 |
| JP | 02-281525 | | 11/1990 |
| JP | 05-135649 | | 6/1993 |
| JP | 05-307925 | | 11/1993 |
| JP | 06-12594 | | 3/1994 |
| JP | 2551754 | | 8/1996 |
| JP | 09-282992 | | 10/1997 |
| JP | 10-177833 | | 6/1998 |
| JP | 11-111135 | | 4/1999 |
| JP | 11238440 | A * | 8/1999 |
| JP | 2001-049092 | | 2/2001 |
| JP | 2002-163966 | | 6/2002 |
| JP | 2003-317589 | | 11/2003 |
| JP | 2003-317590 | | 11/2003 |
| JP | 2004-095524 | | 3/2004 |
| JP | 2004-119255 | | 4/2004 |

OTHER PUBLICATIONS

U.S. Appl. No. 11/229,489, filed Sep. 15, 2005, Yoshikawa et al.

* cited by examiner

THERMAL FUSE USING THERMOSENSITIVE MATERIAL

TECHNICAL FIELD

The present invention relates generally to thermal fuses accommodating thermosensitive material in a cylindrical enclosure and allowing a spring to act thereon to interrupt a circuit at a predetermined temperature or allow the circuit to conduct at the predetermined temperature, and particularly to thermal fuses employing thermosensitive material formed of material selected to provide the thermosensitive material with enhanced workability and durability.

BACKGROUND ART

A thermal fuse has widely been used in a variety of electric home appliances, mobile equipment, communication equipment, business equipment, vehicle-mounted equipment, AC adapters, chargers, motors, batteries and other electronic components as a protective component accurately detecting abnormal overheating of the equipment to rapidly interrupt a circuit or allow the circuit to conduct. Conventionally, thermal fuses have been categorized mainly in two types depending on the fuse element or thermosensitive material used: a thermal fuse using conductive, low-melting fusible alloy; and a thermal fuse using non-conductive, thermosensitive material. These fuses are both a so-called non-reset thermal switch operating in response to an abnormally increasing ambient temperature to interrupt equipment's current or provide a current path with a conducting state to protect the equipment. It operates at a temperature determined by the thermosensitive material used. Typically, it is offered in products as a protective component functioning at a temperature ranging from 60° C. to 250° C. on a rated current ranging from 0.5A to 15A and acts as an electrical protection means allowing an initial conducting or interrupt state for ordinary temperature to be inverted at a predetermined operating temperature to provide an interrupt or conducting state.

The thermal fuse using non-conductive thermosensitive material is typically configured as follows: A cylindrical enclosure has opposite ends each with a lead attached thereto and an organic chemical agent having a prescribed melting point is molded into a predetermined geometry to obtain a thermosensitive material which is then accommodated in the enclosure and for which a compression spring or the like exerts force on a movable conductor to configure the fuse. For example, Japanese Patent Laying-Open No. 10-177833 describes a thermal fuse having an enclosure in the form of a glass tube which has an internal portion provided with a pair of conductive films and accommodates successively a thermosensitive material, a conductor movable between a conducting position and an interrupt position, and a compression spring exerting force on the movable conductor with an insulator posed therebetween.

The thermal fuses using thermosensitive material as described above employ a relatively pure organic chemical for the thermosensitive material. More specifically, this substance is granulated and molded into a predetermined form to provide the thermosensitive material. It is, however, susceptible to the material's softening, deformation, sublimation, deliquescent property and other surrounding, environmental conditions and there have been a large number of concerns in terms of management of production steps, conditions for storing the finished product, and the like. For example, Japanese Patent Laying-Open No. 2-281525 describes that a residual stress introduced when a casing accommodating thermosensitive material and an external leading lead are crimped and thus fixed introduces a gap, which allows external moisture to enter the casing and negatively affect the thermosensitive material. When thermosensitive material having deliquescent property is exposed to external air, the material deforms, sublimates and the like. Accordingly in molding such thermosensitive material a complete management of sealing is required to block external air.

Furthermore, a mold is small in mechanical strength such as hardness. As such, when a thermal fuse is being fabricated a spring's force can deform the mold, resulting in a defect. Furthermore, if a completed thermal fuse is stored at high temperature in high humidity the thermosensitive material sublimates, deliquesces and the like, which can affect the product's longevity and also impair its electrical characteristics. Conventional thermosensitive material employing organic chemical, in particular, when it is exposed to high temperature, significantly softens and deforms. It thus diminishes, resulting in a contact dissociating disadvantageously. Accordingly there has been a need for a thermal fuse using thermosensitive material that is less affected in use by its surrounding environment, chronological variation and the like and also have the thermosensitive material free of defect when the fuse is stored in severe atmosphere, exposed to high temperature and high humidity, toxic gas, and the like.

DISCLOSURE OF THE INVENTION

The present invention has been proposed to resolve the above disadvantages. The present invention notes thermosensitive material's physicochemical property in selecting and using thermosensitive material so as to provide a noble and improved thermal fuse employing thermosensitive material.

In accordance with the present invention the thermosensitive material formed of thermoplastic resin is selected and used. In the selection, a physicochemical property is considered to select a material having a property that allows the material to readily be molded and handled in the production process and can also address the mold's alteration, deformation and the like. As a result, there is provided a thermal fuse employing thermosensitive material that has an improved physicochemical property and steady operating characteristics. More specifically, there is disclosed a thermal fuse employing thermosensitive material, including: a thermosensitive material formed of thermoplastic resin fusing at a prescribed temperature; a cylindrical enclosure accommodating the thermosensitive material; a first lead member attached at one opening of the enclosure, forming a first electrode; a second lead member attached at the other opening of the enclosure, forming a second electrode; a movable conductive member accommodated in the enclosure and engaged with the thermosensitive material; and a spring member accommodated in the enclosure and pressed against the movable conductive member to act on the movable conductive member, and when the thermosensitive member fuses, the electrical circuit between the first and second electrodes switches to an interrupt state or a conducting state.

In particular, it is proposed that the thermosensitive member's main material is formed of thermoplastic resin mixed with an additive providing desired physicochemical properties, e.g., a filler formed of an inorganic substance to enhance electrical characteristics including insulation resistance, dielectric strength and the like, an agent improving mechanical properties including moldability, strength and the like, and an agent improving chemical properties including anti-oxidation or anti-aging. This can reduce deformation and alteration introduced in thermosensitive material using organic chemical as conventional. The present thermal fuse employing thermoplastic resin that provides steady operating characteristic can thus be obtained.

BEST MODES FOR CARRYING OUT THE INVENTION

Figure 1A:
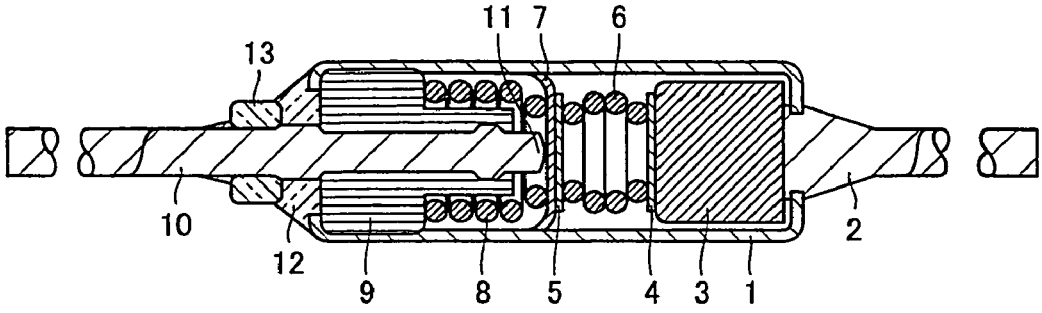
FIG. 1A is a longitudinal cross section of a thermal fuse using thermosensitive material in accordance with the present invention at room temperature.

The present thermal fuse employing thermosensitive material is, for example, as shown in FIG. 1A, formed of a thermosensitive material 3 formed of thermoplastic resin fusing at a prescribed operating temperature, a cylindrical metallic casing corresponding to a cylindrical enclosure 1 accommodating thermosensitive material 3, a first lead member 2 crimped and thus attached to one opening of the casing and allowing the casing's internal wall surface to be a first electrode, an insulated bushing 9 arranged adjacent to the other opening of the casing, a second lead member 10 penetrating bushing 9 and allowing an end thereof to serve as a second electrode, a movable contact corresponding to a movable, conductive member 7 accommodated in the casing and electrically connected to the casing's internal wall, and a spring member 6, 8 accommodated in the casing and engaged with and exerting force on the movable contact. When the thermosensitive material fuses, between the first and second electrodes a switch is made to an interrupt state or a conducting state.

Note herein that in the present thermal fuse, "a switch is made to a conducting state " implies both that the thermosensitive material having reached its melting point exerts a load to interrupt a circuit and that the thermosensitive material having thermally deformed exerts a load to interrupt the circuit. Preferably, the compression spring member is formed of a strong compression spring and a weak compression spring, and the former resists the latter's resilience to press the movable contact against the second electrode. In particular, the strong compression spring has opposite ends arranged between the thermosensitive material and the movable contact with respective pressing plates posed therebetween to facilitate fabrication and also provide steady spring operation and when the thermosensitive material fuses the weak compression spring's force allows the movable contact to be moved to interrupt a circuit so as to provide a thermal fuse that is normally turned on and is turned off in abnormal condition. On the other hand, the strong compression spring can be integrated with the thermosensitive material and arranged in compressed condition. When the thermosensitive material fuses, the strong compression spring acting against force of the weak compression spring moves the movable contact to allow the circuit to conduct so as to provide a thermal fuse employing thermosensitive material that is normally turned off and is turned on in abnormal condition.

The thermoplastic resin selected to form the thermosensitive material is general-purpose plastic, engineering plastic or the like including polyethylene (PE), polypropylene (PP), polystyrene (PS), polyvinyl alcohol (PVA), polyvinylidene chloride (PVDC), polyethylene terephthalate (PET) or similar general-purpose thermoplastic resin, or polyamide (PA), polyacetal (POM), polycarbonate (PC), polybutylene terephthalate (PBT), polyvinylidene fluoride (PVDF), polyphenylene sulfide (PPS), polyamidoimide (PAI), polyimide (PI) polytetrafluoroethylene (PTFE) or similar engineering thermoplastic resin and fluororesin, having a melting point corresponding to a predetermined operating temperature, and having a physicochemical property desired as required. Furthermore, if necessary, two or more types of thermoplastic resin can be combined for use.

More specifically, for an operating temperature of 165° C., polyacetal (POM) resin having a melting point equal to the operating temperature is selected, and for an operating temperature of 220° C., polybutylene-terephthalate (PBT) resin having a melting point close to the operating temperature is selected. The present invention is characterized by a thermal fuse using thermosensitive material of thermoplastic resin, and preferably an approach to improve desired characteristics that depends on the thermoplastic resin's physicochemical property is taken. For example, if the resin chemically readily oxidizes, ages and the like, an antioxidant, an anti-aging agent and the like are preferably mixed together. They are for example 2,6-di-tert-butyl-p-cresol, butylated hydroxy anisole, 2,2'-methylene-bis-(4-ethyl-6-tert-butyl phenol), 1,1,3-tris-(2-methyl-4-hydroxy-5-tert-butylphenyl)butane, dilaurylthiodipropionate, dimyristylthiodipropionate, triphenyl phosphate and the like. For example, if the thermosensitive material is polyethylene, adding 2,6-di-tert-butyl-p-cresol in an amount of 0.001 to 0.1% by mass is effective.

Furthermore, if the thermosensitive material's process or the material that has been processed is unsatisfactory in mechanical strength or electrical insulation-related physical properties, a filler formed of an inorganic substance is preferably added thereto. The filler is advantageously used in improving electric resistance, insulation and the like. The inorganic filler for example includes alumina, silica, calcium silicate, aluminium silicate, carbon black, calcium carbonate, magnesium carbonate, kaolin, talc and the like. Alumina and silica are preferable as they enhance insulation resistance or dielectric strength.

A feature of the present thermosensitive material employing thermoplastic resin is that it can be readily processed and it provides strength larger than thermosensitive material using an organic chemical as conventional. Conventionally, a chemical has been granulated and then tabletted to provide thermosensitive material. Using thermoplastic resin allows injection molding or extrusion to be used to provide mass production inexpensively. In addition, thermosensitive material of thermoplastic resin hardly softens, deforms or deliquesces at high temperature in high humidity due to moisture or sublimates, as is often raised as an issue for the thermosensitive material using an organic chemical. This can not only facilitate storage before incorporation but resolve the thermosensitive material's diminishment with time and an associated defect of a switch function.

The present thermal fuse using thermosensitive material in another embodiment includes a thermosensitive material formed of a thermoplastic resin fusing at a prescribed temperature, a cylindrical, metallic casing accommodating the thermosensitive material, a first lead member crimped and thus fixed to one opening of the casing and allowing the casing's internal wall surface to serve as a first electrode, an insulated bushing arranged adjacent to the other opening of the casing, a second lead member penetrating the bushing and having an end to serve as a second electrode, and two flat plates in the form of tongues extending lengthwise and having conductance and resilience arranged between the first and second electrodes. The two flat plates sandwich the thermosensitive material and have a rear surface brought into contact with the casing's internal wall surface and when the thermosensitive material fuses the flat plates are narrowed to provide a non-contact condition.

In still another embodiment, a thermal fuse using thermosensitive material is also disclosed as follows: a cylindrical, insulated tube accommodates thermosensitive material. First and second lead members are fixed to the tube's openings, respectively, and also electrically connected to first and second electrodes formed at an internal wall surface of the casing. A conductor movable from a conduction position to an interrupt position of the first and second electrodes is accommodated in the tube and pressed against the thermosensitive material via an insulator by a spring arranged at one end of the tube.

FIRST EXAMPLE

Figure 1B:
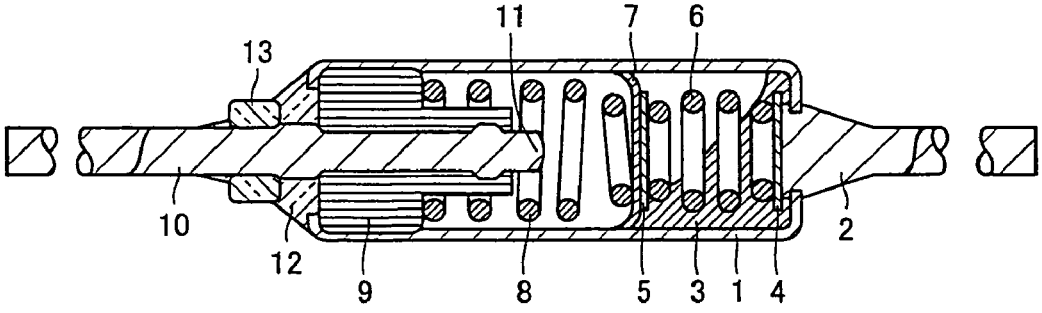
FIG. 1B is a longitudinal cross section of the thermal fuse employing thermosensitive material of the present invention at an abnormally increasing temperature.

FIGS. 1A and 1B show a thermal fuse using thermosensitive material of the present example. FIG. 1A is a cross section thereof at room temperature as normal, and FIG. 1B is a cross section of the thermal fuse in operation when it is abnormally heated. The present thermal fuse is configured of: a cylindrical, metallic casing corresponding to an enclosure 1 formed of copper, brass or similarly good conductor and presenting satisfactory thermal conductance; a first lead member 2 crimped and thus fixed to one opening of the casing; a switch function component including a thermosensitive material 3, a pair of pressing plates 4 and 5, a spring member 6 in the form of a strong compression spring, and a movable, conductive member 7 in the form of a movable contact formed of silver alloy satisfactorily conductive and adequately resilient, and a spring member 8 in the form of a weak compression spring, all accommodated in the casing; an insulated bushing 9 inserted into the other opening of the casing; and a second lead member 10 penetrating bushing 9 and thus insulated from the casing.

Furthermore, a fixed contact 11, located at an inner end of the second lead member 10, is brought into contact with the movable contact at room temperature, as shown in FIG. 1A, and spaced therefrom, as shown in FIG. 1B, when temperature abnormally increases. Furthermore, a resin seal 12 seals the casing's opening, bushing 9 and the second lead member 10. Furthermore, an insulated bushing 13 sufficiently raises resin seal 12 at the casing's opening for sealing. Herein, thermosensitive member 3 is formed mainly of thermoplastic resin and molded, and a material which fuses at a prescribed temperature at which the thermal fuse operates is selected and used. Furthermore, utilizing excellent thermosensitive material's strength can eliminate pressing plate 4 and still similarly allow the fuse to be stored for a long a period of time and the absence of plate 4 also allows a quick-response thermal fuse.

SECOND EXAMPLE

The present invention in another example provides a thermal fuse having a simple structure using a thermosensitive material of thermoplastic resin, as described hereinafter. This thermal fuse includes, similarly as has been described in the previous example, a thermosensitive material formed of thermoplastic resin fusing at a particular operating temperature, a cylindrical metallic casing accommodating the thermosensitive material, a first lead member crimped and thus fixed to one opening of the casing and allowing the casing's internal wall surface to serve a first electrode, an insulated bushing inserted into and thus fixed to the other opening of the casing, and a second lead member penetrating the bushing and having an end serving as a second electrode, and further includes two flat plate springs sandwiching the thermosensitive material to provide both the function of a movable conductive member and that of a spring member, the flat plate spring being arranged between the first electrode corresponding to the internal wall surface of the casing and the second electrode corresponding to an end of the second lead member.

More specifically, the flat plate springs formed of two pieces in the form of tongues having conductance and resilience and extending lengthwise have one end fixed and electrically and mechanically coupled with the second electrode of the second lead member and the other end formed of two pieces, opened desirably, and between the flat plates at the opened side the thermosensitive material is inserted and thus allows the spring to exert force to hold the thermosensitive material and simultaneously the flat plates have their rear surfaces brought into contact with the first electrode of the internal wall surface of the casing. As such, at normal, room temperature a conducting state is maintained via the flat plate spring, and when the ambient temperature reaches a particular temperature or more the thermosensitive material fuses and the flat plate spring is thus compressed and disengaged from the casing's internal wall surface to interrupt an electrical circuit between the first and second lead members.

It has been confirmed that when the thermoplastic resin is for example polyacetal (POM) resin or polybutylene-terephthalate (PBT) resin, the thermal fuse operates, for ten samples, at 160.5 to 162.5° C. and 225 to 227° C., respectively, and that as a variation in operation, $\Delta T=2°$ C. In this example, in reducing the number of components of the thermal fuse to simplify its structure, the strength of the thermoplastic resin of the thermosensitive material is effectively exhibited.

THIRD EXAMPLE

In the present example, a thermal fuse using thermosensitive material is configured as follows: A cylindrical insulated tube accommodates thermosensitive material. First and second lead members are fixed to the tube's openings, respectively. First and second electrodes are formed each at a portion of an internal wall surface of the casing. A spherical conductor movable from a conducting position to an interrupt position of the first and second electrodes is accommodated in the tube. The spherical conductor is pressed by a spring toward the thermosensitive material with a spherical insulator posed therebetween. The spring is arranged at one end of the tube and presses the spherical conductor against the thermosensitive material via the spherical insulator. As normal, the conductor is in contact with the internal wall surface's first and second electrodes and positioned to maintain a circuit's conduction state. As temperature increases and the thermosensitive material's temperature exceeds a particular temperature, the thermosensitive material fuses and thereby the conductor is moved by the spring's force to the interrupt position to interrupt the circuit. This example is also simplified in structure and a thermosensitive material of thermoplastic resin advantageous in strength is effectively utilized.

INDUSTRIAL APPLICABILITY

In accordance with the present invention, thermosensitive material can be selected from a wide range of thermoplastic resin and relatively inexpensively offered, and, as required, an additive can be used to alter physical and chemical properties to provide enhanced moldability, prevent the molded thermosensitive material from deformation and alteration, and achieve increased longevity and stable operation. In particular, the ready fabrication and the thermosensitive material's improved strength can help simplify components of the thermal fuse using the thermosensitive material to offer an inexpensive product. Furthermore in connection with its storage and chronological variation, the thermal fuse that does not use any organic chemicals as conventional can be stable for a long period of time even in high humidity, a toxic, gaseous ambient or the like. It can be protected from erosion and free of impaired insulation level, and not only in storage but also in use it can prevent degradation in performance including electrical characteristics and also reduce chronological variation to provide a significant, practical effect such as helping to improve stability and reliability allowing operation constantly at a prescribed temperature accurately.

The invention claimed is:

1. A thermal fuse comprising:

a thermosensitive member comprising a polyolefin material fusing at a prescribed temperature, and an anti-oxidant or an anti-aging agent;

a cylindrical enclosure accommodating said thermosensitive member;

a first lead member attached at a first opening of said enclosure, forming a first electrode;

a second lead member attached at a second opening of said enclosure, forming a second electrode;

a movable conductive member accommodated in said enclosure and engaged with said thermosensitive member; and a spring member accommodated in said enclosure and pressed against said movable conductive member to act on said movable conductive member, said thermosensitive member fusing at an operating temperature to switch an electrical circuit located between said first and second electrodes.

2. The thermal fuse of claim 1, wherein said thermosensitive member further comprises alumina or silica.

3. The thermal fuse of claim 1, wherein said anti-oxidant or said anti-aging agent is 2,6-di-tert-butyl-p-cresol.

4. The thermal fuse of claim 1, wherein said cylindrical enclosure is a cylindrical metallic casing having an end with said second opening receiving an insulated bushing, said first lead member is crimped, fixed to and thus electrically and mechanically coupled with said first opening of said metallic casing and also has said first electrode formed at an internal wall surface of said casing, said second lead member penetrates said bushing and is insulatively attached at said second opening of said metallic casing and has an end thereof forming said second electrode, said movable conductive member is a movable contact that is movable as desired between said first and second electrodes, and said spring member is a compression spring member engaged with said movable contact.

5. The thermal fuse of claim 4, wherein said compression spring member comprises a strong compression spring and a weak compression spring and wherein when said thermosensitive member is not fused, said strong compression spring acts against a resilience of said weak compression spring to allow said movable contact to abut against said second electrode.

6. The thermal fuse of claim 5, wherein said strong compression spring is arranged between said thermosensitive member and said movable contact and when said thermosensitive member fuses, a force of said weak compression spring moves said movable contact to interrupt a circuit.

7. The thermal fuse of claim 5, wherein said strong compression spring is arranged as compressed by said thermosensitive member, and when said thermosensitive member fuses, said strong compression spring acts against a force of said weak compression spring to move said movable contact to allow said electrical circuit to conduct.

8. The thermal fuse of claim 1, wherein said cylindrical enclosure is a cylindrical metallic casing having an end with said second opening sealed by an insulated bushing, said first lead member is crimped, fixed to and thus electrically and mechanically coupled with said first opening of said metallic casing and also forms said first electrode at an internal wall surface of said casing, said second lead member penetrates said bushing and is insulatively attached at said second opening of said metallic casing and at an end thereof forms said second electrode, said movable conductive member and said spring member are two flat plates in a form of tongues extending lengthwise and having conductance and resilience arranged between said first and second electrodes, said two flat plates sandwich said thermosensitive member to achieve contact with said internal wall surface of said metallic casing and when said thermosensitive member fuses, a spacing between said flat plates is reduced to achieve a non-contact condition.

9. The thermal fuse of claim 1, wherein said cylindrical enclosure is a cylindrical, insulated tube, said first and second lead members are fixed to said first and second openings of said tube, respectively and also form said first and second electrodes, respectively, at an internal wall surface of said tube, said movable conductive member is a conductor that is movable from a conducting position of said first and second electrodes to an interrupt position of said first and second electrodes, said spring member is arranged at one end of said tube, and via an insulator said conductor is pressed against said thermosensitive member.

* * * * *

UNITED STATES PATENT AND TRADEMARK OFFICE

CERTIFICATE OF CORRECTION

PATENT NO. : 7,323,965 B2
APPLICATION NO. : 10/512167
DATED : January 29, 2008
INVENTOR(S) : Yoshikawa It is certified that error appears in the above-identified patent and that said Letters Patent is hereby corrected as shown below:

Column 1,
After line 56, insert the following paragraph:
--Japanese Patent Laying-Open No. 5-307925 describes that a cylindrical enclosure in the form of a metallic casing is used with one opening's lead crimped and thus fixed and the other opening's lead fixed via an insulated bushing and thermosensitive material is introduced into the casing between two spring plates and at room temperature the spring plates are brought into contact with an internal wall surface of the casing so as to provide a simply structured thermal fuse. Furthermore, Japanese Patent Laying-Open No. 9-282992 describes a thermal fuse employing a metallic casing which has one end with a leading lead electrically connected and receives an elastic body, a thermosensitive material, a piece of metal, a movable piece in the form of a spring, and sealing ceramic successively, the ceramic being penetrated by the other lead. Furthermore, Japanese Patent Laying-Open Nos. 5-135649 and 11-111135 describe a well-known thermal fuse using a spring member in the form of a strong compression spring and a weak compression spring to exert force on a movable contact body to ensure a movement for an operating temperature.--

Signed and Sealed this

Ninth Day of June, 2009

John Doll

JOHN DOLL
*Acting Director of the United States Patent and Trademark Office*